United States Patent [19]

Bertrand

[11] Patent Number: 4,802,876

[45] Date of Patent: Feb. 7, 1989

[54] AXLE STRUCTURE AND AXLE JOINT FOR CONSTRUCTION TOY ASSEMBLY

[75] Inventor: Vic Bertrand, Dollard des Ormeaux, Canada

[73] Assignee: The Ritvik Group Inc., Dorval, Canada

[21] Appl. No.: 100,300

[22] Filed: Sep. 23, 1987

[51] Int. Cl.[4] ..... A63H 17/00; A63H 17/26

[52] U.S. Cl. ..... 446/95; 446/469

[58] Field of Search ..... 446/95, 96, 94, 93, 446/85, 102, 103, 105, 128, 448, 465, 469, 470, 471

[56] References Cited

U.S. PATENT DOCUMENTS

| | | | |
|---|---|---|---|
| 3,310,906 | 3/1967 | Glukes | 446/95 |
| 3,651,597 | 3/1972 | Daenen | 446/95 X |
| 4,299,051 | 11/1981 | Pauly et al. | 446/471 |
| 4,375,139 | 3/1983 | Chatani | 446/471 |
| 4,522,001 | 6/1985 | Meyer | 446/128 X |
| 4,619,625 | 10/1986 | Seki et al. | 446/95 X |
| 4,624,647 | 11/1986 | Munnix | 446/95 X |

FOREIGN PATENT DOCUMENTS

| | | | |
|---|---|---|---|
| 2649017 | 10/1976 | Fed. Rep. of Germany | 446/93 |
| 8601738 | 3/1986 | PCT Int'l Appl. | 446/95 |

*Primary Examiner*—Robert A. Hafer
*Assistant Examiner*—D. Neal Muir
*Attorney, Agent, or Firm*—Robic, Robic & Associates

[57] ABSTRACT

A one-piece plastic axle structure comprises a base plate, an abutment plate normal to one edge of the base plate, a cross-shaped columnar connector perpendicular to the base plate and a cross-shaped shaft perpendicular to the abutment plate; the shaft having bulges at its free end and the end of the abutment plate being rounded. The axle structure is connected to a wheel having a shaft bearing defining a bore and a counterbore; the shaft of the axle structure fitting into the shaft bearing with its bulges received in the bearing counterbore and the shaft proper received in the bore. The axle structure is further connected to a construction toy block having a parallelepiped hollow body and a plurality of hollow plugs opening into the body; the columnar connector fitting into one of the hollow plugs with an adjacent side wall of the body falling between the abutment plate and the columnar connector; the lower end of the abutment plate being rounded and resting on the inner face of the wheel tread.

12 Claims, 1 Drawing Sheet

AXLE STRUCTURE AND AXLE JOINT FOR CONSTRUCTION TOY ASSEMBLY

BACKGROUND OF THE INVENTION

1. Field of the Invention

The present invention falls into the field of construction toy assemblies using brick-like units and it is more specifically related to an axle structure and to an axle joint for such assembly.

2. Description of the Related Art

Brick-like units for use in the above known construction toy assemblies have generally all the same features. They are hollow bodies made of plastic material, rectangular in cross-section, and formed with connection plugs projecting from one face only. The end of the unit which is opposite from the connection plugs is open to permit the insertion of connection plugs of other like construction units. In most of these construction toy assemblies, at least one and usually a limited number of the units are also wheel-mounted so as to appreciably increase the interest in the construction game by diversifying its possibilities.

Now, the mounting of wheels on such a construction unit or block to make it into a vehicle has so far been troublesome and costly for a variety of reasons and it is precisely an object of the present invention to provide an improved one-piece plastic axle structure which is very effective and sturdy in use, while being low in cost. The axle structure, when applied to a wheel hub bearing and to a vehicle side wall adequately formed and dimensioned will form an axle joint, such joints resulting into a toy wheeled vehicle that can easily resist any tampering by children as well as constantly insuring proper rotation of the wheels.

SUMMARY OF THE INVENTION

In view of the above object and according to one aspect of the invention, there is provided a one-piece plastic axle structure comprising: a base plate having a straight edge; a columnar connector, of essentially constant cross-section, projecting perpendicularly away from one face of the base plate; and abutment plate solid with the straight edge of the base plate and extending perpendicularly to the base plate; the abutment plate having a first portion extending in a direction away from the other face of the base plate; a shaft projecting perpendicularly from the end of the abutment plate adjacent the base plate and being formed, at the free end thereof, with outward bulges, and wherein the abutment plate is rounded at the end thereof away from the base plate. The above abutment plate preferably has a second portion which extends in a direction away from the one face of the base plate; the columnar connector being spaced from this second portion.

According to another aspect, the invention provides for an axle joint comprising: a cup-shaped wheel which includes: a cylindrical tread having a transverse web at one end and being open at the other end; further including a shaft bearing projecting from the web inwardly of the tread, and wherein the shaft bearing has a bore along a first bearing position, adjacent the web. The joint further comprises a toy assembly block including: a hollow parallelepiped rectangular body having a side wall, a top wall and a hollow connector plug projecting perpendicularly away from the top wall and opening into the body. There is finally provided a one-piece plastic axle structure as afore-described. The latter is so dimensioned that the shaft is mounted into the shaft bearing with the outward bulges fitted into the counter bore; the bearing has a terminal edge, at the end away from the wheel web, in abutment against the abutment plate; the rounded end of the abutment plate bears against the inner surface of the wheel cylindrical tread, and the columnar connector is fitted into the hollow connector plug of the toy assembly block.

A description now follows of a preferred embodiment of the invention having reference to the appended drawing.

DESCRIPTION OF THE PREFERRED EMBODIMENT

Figure 1:
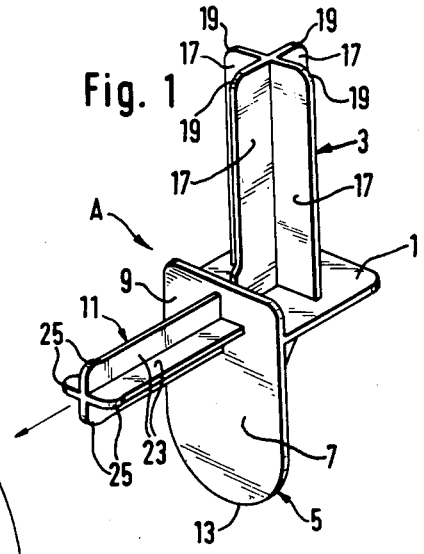
FIG. 1 is a perspective view of an axle structure made according to the invention.
Figure 2:
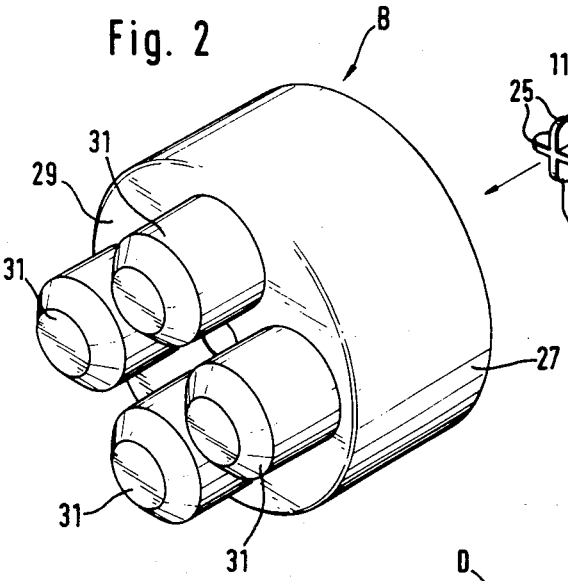
FIG. 2 is a perspective view of a wheel to which the axle structure of FIG. 1 is mounted.
Figure 3:
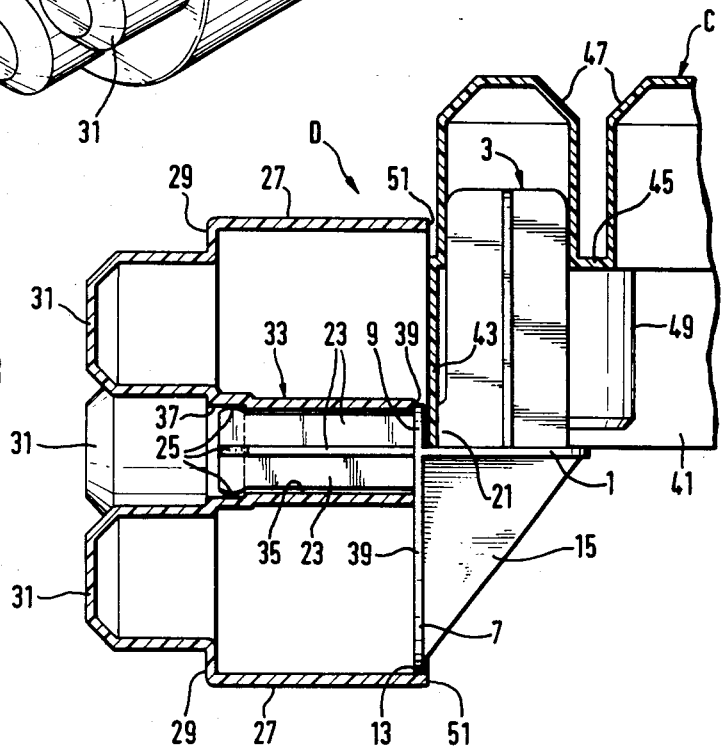
FIG. 3 is a view, partly in cross-section and partly in side elevation, illustrating an axle joint according to the invention.

Referring to FIG. 1, the one-piece plastic axle structure A is shown to be made up of a generally square base plate 1 from one face of which a columnar connector 3 upwardly perpendicularly projects; an abutment plate 5 solid with one straight edge of the base plate and extending perpendicularly to the base plate, having a major portion 7 projecting down from the base plate 1 and a minor portion 9 projecting up from it, and made up also of a shaft 11 projecting perpendicularly from the abutment plate 5 in the area between the major and minor portions 7, 9, of the said plate 5. The lower end of the major portion 7 is rounded as at 13. As best shown in FIG. 3, a triangular reinforcing plate 15 joins the abutment plate lower portion 7 and the base plate 1.

The columnar connector 3 is constituted by flat wings 17 of equal length and depth radiating from its longitudinal axis; preferably being cruciform in shape with the wings coplanar in pairs and having rounded outer edges 19 at their free ends. As best shown in FIG. 3, one of the wings 17 is normal to and spaced from the minor portion 9 of the abutment plate 7, being additionally formed with a distancing lug 21 of which the outer edge is spaced from the said minor portion 9, that is, adjacent the base plate 1.

The shaft 11 is also preferably cruciform in shape, like connector 3, with four flat radiating wings 23 of equal size coplanar two-by-two. It will be noted, in FIG. 3, that two coplanar wings 23 are also coplanar with the base plate 1. The wings 23 have straight edges along a major portion and are formed with outward, preferably round, bulges 25 at their free ends.

The axle structure A serves for connecting a wheel B and a toy assembly block C into the axle joint D shown in FIG. 3.

The wheel B is a cup-shaped body having a cylindrical tread 27 open at one end and having a transverse web 29 at the other end; hollow connection plugs 31 projecting from the web 29, in conventional manner in this art. A shaft bearing 33 projects perpendicularly from the web 29, having a bore 35 along its major portion and a counterbore 37 along the remaining portion adjacent the web 29. When joined together, as in FIG. 3, the shaft 11 is fitted into the bearing 33 with its major portion housed in the bore 35 and its bulges 25 housed in the counterbore 37. As will be noted, the shaft bearing 33 has a terminal edge 39 which is in abutment against the abutment plate 5; the rounded edge 13 of the latter then bearing against the inner surface of the tread 27.

The toy assembly block C is of conventional construction and comprises a hollow parallelepiped rectangular body 41 having a side wall 43, a top wall 45 and upwardly projecting hollow plugs 47 opening into the body 41 and of which one is located close to the sidewall 43. One stabilizing member 49 is visible within the body 41 but has no connection with the present invention. The axle joint D is completed by having the sidewall 43 fitted into the space between the distancing lug 21, aforesaid, and the upper portion 9 of the abutment plate 5; the lower edge of the body 41 partly resting on the top face of the base plate 1. At the same time, the upper part of the columnar connector 3 of the axle structure A is snugly slid into the adjacent plug 47. Finally, the terminal edge 39 of the wheel bearing 33 lies inside the wheel tread 27, that is, short of the terminal edge 51 of the tread 27. From a study of FIG. 3, it will be appreciated that the axle joint D can easily be assembled and is quite sturdy and stable, in use.

In mounting the shaft 11, the bulges 25 are easily force-fitted through the bore 35 before snapping into the counterbore 37; this movement as well as the reverse movement being made possible because of the resiliency of the plastic material of which the wings 23, the bulges 25 and the shaft bearing 33 are made. By properly dimensioning the shaft 11 and the bearing 33, it can be assured that the abutment plate 5 will provide great stability to the wheel B by having the terminal edge 39 flat against it. Also, a least amount of surface of the shaft 11 will bear against the bore 35 and the counterbore 37 of the bearing 33 thereby facilitating rotation of the wheel B; the bearing surface being indeed limited, in this embodiment, only to the outer edges of the shaft wings 23. Finally, any weight applied to the block C will be transferred mostly to the rounded edge 13 of the abutment plate 5 and hence to the portion of the wheel tread 27 riding along the track surface on which the wheel B is made to roll.

I claim:

1. A one-piece plastic axle structure comprising:

a base plate having an upper face, a lower face, a straight edge and having a free perimeter;

an abutment plate solid with the straight edge of the base plate, said abutment plate extending perpendicularly to the base plate and having a minor portion projecting up from the base plate, away from the upper face of said base plate, and a major portion projecting down from the base plate, away from the lower face of said base plate, said major portion having a rounded lower end, said rounded lower end having an accessible edge.

a columnar connector of essentially constant cross-section extending upwardly perpendicularly from the upper face of the base plate, said columnar connector being spaced from the minor portion of said abutment plate;

a reinforcing plate extending perpendicularly to both the abutment plate and base plate, between the major portion of said abutment plate and the lower face of said base plate, and a shaft projecting perpendicularly from said abutment plate in a direction opposite to said base plate, said shaft having, opposite said abutment plate, a free end formed with outward bulges whereby when said shaft engages a wheel said accessible edge may support said wheel when said axle structure is stressed downwardly.

2. An axle structure as claimed in claim 1, wherein is formed of flat wings of equal length and depth radiating from said connector longitudinal axis, one of said connector wings being perpendicular to the minor portion of the abutment plate; and the shaft has a longitudinal axis and is formed of flat wings of equal length and depth, said shaft wings radiating from said shaft longitudinal axis and being formed with said outward bulges at the free end of said shaft.

3. An axle structure as claimed in claim 2, wherein said shaft comprises four shaft wings and is cruciform in cross-section, two of said wings and said base plate being co-planar.

4. An axle structure as claimed in claim 2, wherein said one connector wing of said columnar connector perpendicular to said minor portion of said abutment plate is formed, adjacent said base plate, with a distancing lug having an outer edge spaced from said minor portion of said abutment plate.

5. An axle structure as claimed in claim 4, wherein said outward bulges of said shaft wings are rounded.

6. An axle structure as claimed in claim 4, wherein said connector wings of said columnar connector have rounded upper edges.

7. An axle structure as claimed in claim 4, wherein said columnar connector is constructed for snug insertion into a hollow cylindrical plug of a construction toy block having one side wall of a predetermined thickness; said space between said distnacing lug and said minor portion of said abutment plate being equal to said predetermined thickness for fitting of said block one side wall therebetween.

8. An axle structure as claimed in claim 4, wherein said shaft comprises four shaft wings and is cruciform in cross-section, two of said wings and said base plate being co-planar.

9. An axle structure as claimed in claim 8, wherein said columnar connector comprises four wings and is cruciform in cross-section.

10. An axle joint comprising:

a cup-shaped wheel including a cylindrical tread having a transverse web at one end and being open at the other end and a shaft bearing projecting from said web inwardly of said tread, said shaft bearing having a terminal edge opposite the web a central bore extending over most of the length of said shaft bearing and a counter bore adjacent said web, said cup-shaped wheel defining, at the open end thereof, a terminal edge falling in a terminal plane, said terminal edge of said shaft bearing being located inside said wheel tread, short of said terminal plane;

a toy assembly block including a hollow parallelepiped rectangular plastic body having a side wall, a top wall and at least one hollow connector plug projecting perpendicularly away from said top wall and opening into said rectangular body; and a one-piece plastic axle structure as claimed in claim 1, said structure operatively connecting said wheel and said block and being dimensioned so that:

said shaft is mounted into said shaft bearing with said outward bulges fitted into said counterbore; the terminal edge of said shaft bearing is in abutment against said abutment plate;

said rounded lower end of the major portion of said abutment plate bears against the inner surface of said wheel cylindrical tread, and said columnar connector is fitted into said hollow connector plug of said toy assembly block.

11. An axle joint as claimed in claim 10, wherein said columnar connector has a longitudinal axis and is formed of flat wings of equal length and depth radiating from said longitudinal axis, one of said connector wings being perpendicular to the minor portion of said abutment plate and being formed adjacent said abutment plate, with a distancing lug having one outer edge spaced from said abutment plate, and wherein said sidewall of said assembly toy is fitted between said distancing lug and said abutment wall.

12. An axle joint as claimed in claim 11, wherein said shaft has a longitudinal axis and is formed of four wings of equal length and depth radiating from said shaft longitudinal axis, said shaft being cruciform in cross-section, two of said wings and said base plate being coplanar.

* * * * *